United States Patent [19]

Young et al.

[11] Patent Number: 4,649,241

[45] Date of Patent: Mar. 10, 1987

[54] SOLENOID ACTUATED HIGH SPEED, HIGH CURRENT MAKING SWITCH WITH A MOVABLE CONTACT RING

[75] Inventors: John W. Young, Lilburn; Roger D. Luke, Stone Mountain; Henry J. Rhodes, Decatur; Jeffrey K. Hudgins, Mableton, all of Ga.

[73] Assignee: Siemens-Allis, Inc., Atlanta, Ga.

[21] Appl. No.: 669,947

[22] Filed: Nov. 9, 1984

[51] Int. Cl.[4] ..... H01H 35/38

[52] U.S. Cl. ..... 200/82 R; 200/16 E; 200/318; 335/254

[58] Field of Search ..... 335/254; 200/318, 321, 200/323, 16 E, 262, 266, 271, 81 R, 82 R, 82 B, 83 N

[56] References Cited

U.S. PATENT DOCUMENTS

| | | | |
|---|---|---|---|
| 2,843,706 | 7/1958 | Oppel | 200/16 E |
| 3,835,277 | 9/1974 | Skreiner | 200/318 |
| 3,839,608 | 10/1974 | De Vries | 200/82 R |
| 4,327,344 | 4/1982 | Luckenback | 335/254 |

FOREIGN PATENT DOCUMENTS

| | | | |
|---|---|---|---|
| 803754 | 10/1936 | France | 200/16 E |

OTHER PUBLICATIONS

AEG, Synchronized Make Switch Precision 100 μS Allgemeine Elektricitats-Gesellschaft AEG-Telefunken.

*Primary Examiner*—G. P. Tolin

*Attorney, Agent, or Firm*—F. W. Powers; J. L. James

[57] ABSTRACT

A high-speed, high-current making switch is provided which has a driver which forms an air cylinder in the housing and which has movable contacts attached thereto. The driver moves the contacts to make and break the circuit. The force to move the driver is provided by pressurized air within the housing chamber which in response to the operation of a solenoid which operates a latch allows the contacts to make very rapidly. Upon operation of the solenoid, the latch is removed from abutting contact with the driver thereby allowing the driver to move in response to the air pressure and make the circuit.

18 Claims, 2 Drawing Figures

SOLENOID ACTUATED HIGH SPEED, HIGH CURRENT MAKING SWITCH WITH A MOVABLE CONTACT RING

BACKGROUND OF THE INVENTION

This invention relates generally to a making switch and more particularly to a making switch which is used in short circuit testing stations for making the short circuit current in the circuit at the correct instant.

From time to time, as part of a quality control or test procedure, it is necessary to perform short circuit tests where high currents are involved. To perform these tests, a switch is needed which can handle the high current when making the circuit. Normally, handling a high current merely means increasing the contact area; however, for performing short circuit tests and other tests, the high current must be handled in a precise timing sequence. This means that the switch must be able to make the circuit while synchronized with the rest of the test procedure. Accordingly, it will be understood that it is highly desirable to have a switch which can make a circuit and handle high current at a fast operating speed.

A making switch, true to its name, is used to make a circuit as opposed to a circuit breaker which both makes and breaks a circuit. Therefore, the making switch need not have the capacity to carry the high currents for an indefinite period of time. The making switch closes the circuit and another switch will carry the load current. Accordingly, it will be understood that it is highly desirable to provide a synchronized make switch which can be used in short circuit testing stations for making the short circuit current in the circuit at the correct instant. The switch must be capable of making high currents at constant switching times and with minimal deviation in closing time. Typically, at test stations the impulse short circuit currents and also the short time currents are mostly higher than the currents occurring in normal high voltage installations. Such ratings can be reliably handled only by special switches.

Accordingly, it is an object of the present invention to provide a make switch for use in a testing station for making the short circuit current in the circuit at the correct instant. It is also an object of this invention to provide a make switch capable of making high currents at constant switching times with a minimum deviation.

SUMMARY OF THE INVENTION

In accordance with one aspect of the invention, a making switch is provided which includes a housing which defines a chamber therein. A driver has a first end portion which extends into the housing chamber and moves a movable contact ring between an open and a closed postion. The middle portion of the driver and the housing form an air cylinder which controllably moves the first end portion of the driver in the chamber. The movable contact ring has a plurality of contacts which are engageable with the contacts of a stationary contact ring. A latch is associated with the driver and configured to abuttingly engage the driver when the contacts are in the open position. A solenoid is positioned for operating the latch and freeing the driver of abutting contact with the latch and allowing the contacts to close.

Upon operation of the latch, the driver quickly closes the contacts. The switch can handle high currents because it has multiple contacts arranged in rings and the making of the contacts can be synchronized by the operation of the solenoid.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
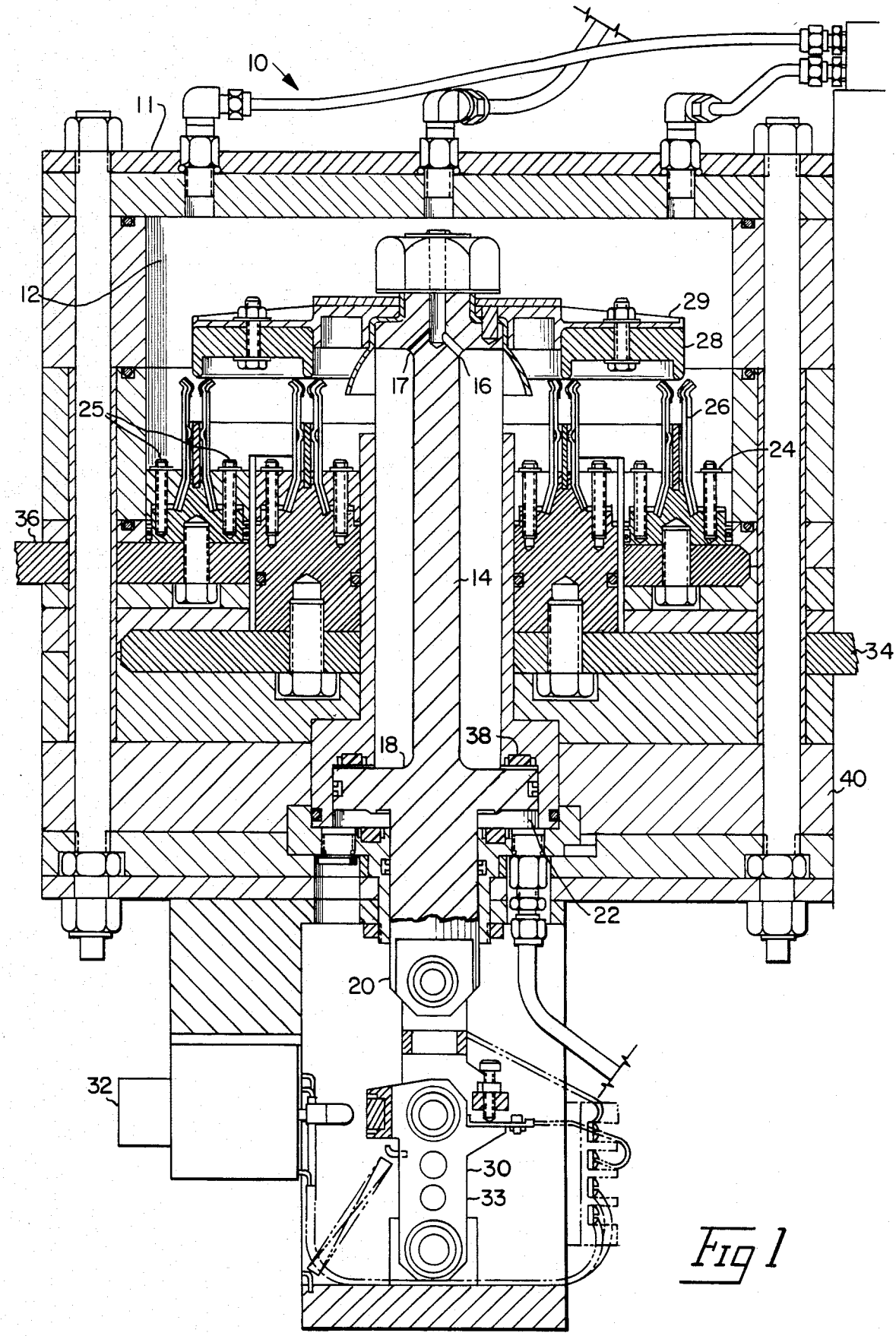
FIG. 1 is a diagrammatic longitudinal cross-sectional view of the make switch with certain parts shown in elevation.
Figure 2:
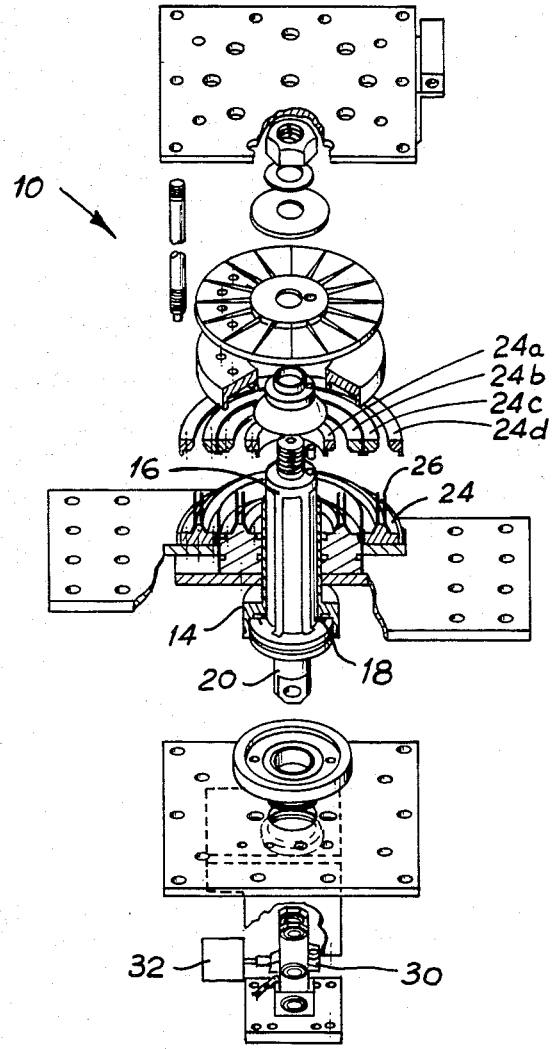
FIG. 2 is a simplified assembly diagram of the make switch shown in FIG. 1.

Referring to FIGS. 1 and 2, a high-speed, high-current making switch 10 is shown which includes a housing 11 which defines a chamber 12 therein. A driver 14 has a first end portion 16 which extends into the housing chamber 12 and a middle portion 18 and a second end portion 20. The middle portion 18 and the housing 11 form an air cylinder 22 which controllably moves the first end portion 16 of the driver 14 in the chamber 12.

A stationary contact ring 24 which has a plurality of contact fingers 26 is mounted in the housing 11. A movable contact ring 28 which has a plurality of contacts which engage the contact fingers 26 is movable by the driver 14 between an open position and a closed position. A latch 30 abuts the driver 14 when the contacts are in the open position. A solenoid 32 operates the latch 30 which frees the driver 14 of abutting contact with the latch 30 allowing the contacts to close. By this construction, pressurized air in the housing which acts on the second end portion of the driver rapidly moves the driver and the movable contacts when the solenoid operates the latch.

Referring to FIG. 1, basically, the housing includes non-magnetic stainless steel members which are held together by a plurality of bolts. Copper is used for connection to the circuit terminals. The driver is constructed of aluminum. Spaces in the housing are filled with a glass epoxy material which is a good insulator in this environment the housing 11 is contructed of stainless steel and all members with like cross-hatching are also stainless steel. Circuit terminals 34 and 36 are copper as are all members with like cross-hatching. The driver 14 is constructed of aluminum and the bumpers or pads 38 are polyurethane. The housing members or spacers 40 are formed of a glass epoxy material. Members with the same cross-hatching as the above elements are constructed of the same material.

In the stationary contact ring, the use of series knife blades provides the necessary insulated air gap and reduces the movement necessary to affect closure, thus helping timing accuracy. The contact fingers are mounted in pairs opposing one another and arranged in two concentric circles. Positioning the contacts in opposing relation in each pair makes use of the available magnetic force to prevent blow-off. The contact fingers preferably have wear pads on their ends. Preferably, the wear pads are constructed of a coin silver alloy with a conductivity of about 95%.

The movable contact has the knife blade portions plated with about 0.010 inches of pure silver. While it is expected that silver oxides will be formed due to the heat rise of the contacts, these oxides are soft and can be easily broken by the contact finger pressure which is about seven pounds per contact. The contact pressure is provided by contact springs which are constructed of beryllium copper. As the copper is soft, alloy 102 or alloy 110 is used for maximum conductivity. Beryillium copper is utilized for the contact springs because they are not affected by the high temperatures and are non-magnetic. The contact fingers are attached to the contact rings so that they can be readily replaced for easy maintenance as well as ensure the high clamping forces necessary to ensure a low resistance joint.

A set of four non-magnetic stainless steel clamp rings 24*a*, 24*b*, 24*c* and 24*d* with tapered or ramped inner or outer diameters provides a simple, effective method for attaching the contact fingers in the circular contact arrangement. The ramp angle, preferably about 75°, converts the downward clamping force of the bolts 25 into a very high lateral force which takes advantage of the high hoop strength in the rings. A slight upset in the contact springs in the area of the clamp rings ensures equal clamping force. This upset also compensates for slight differences in thickness of the various contact fingers and springs which might vary slightly due to manufacturing deviations.

The movable contact ring is supported by a non-magnetic stainless steel retainer 29 which is machined to a thin plate with stiffening webs provided to ensure rigidity without imposing a mass penalty. The driver is a multi-purpose, one piece unit machined from aluminum. The driver 14 is the main bearing member for the movable contact ring assembly, the air piston, one end of the latch, and it incorporates cooling air passages 17 for the contacts. The exterior of the driver is hard anodized to provide good wear characteristics in the glass epoxy cylinder liner. The glass epoxy also forms the upper air chamber. Instead of being a solid cylindrical mass, almost 40% of the mass of the driver is removed by milling slots and boring holes. In this manner, the upper surface of the second end portion of the driver which is exposed to the housing chamber can have a larger surface area than the underside which is in the cylinder.

As mentioned, the second end of the driver abuttingly engages the latch. The latch 30 is a simple over center toggle linkage with both links 33 (only one shown) of equal length. In the preferred embodiment, the latch is constructed of aluminum. Needle type roller bearings will serve well.

In the preferred embodiment, the length of each latch segment is three inches center line to center line with an adjustable over center travel which adjusts between 0.0 and 0.1 inches. Preferably, the over center travel is 0.03 inches. The force necessary to overcome the latch is less than about 50 pounds. The solenoid used to operate the latch is one of several solenoids available with about 50 to 70 pounds force at the beginning of its stroke. The solenoid has a 0.5 inch stroke and accelerates through half its stroke before striking the latch. At this point it has a 100-pound force and is moving in excess of 80 feet per second which provides more than adequate acceleration to the latch to overcome static pressure and friction.

The motive force for the switch is air pressurized to a pressure of about 180 pounds per square inch. This pressure also helps increase the basic insulation level of the internal contact air gap.

When the making switch is latched, the switch chamber, which is part of the air cylinder, and the lower part of the air cylinder are pressurized simultaneously. There is less total pressure on the bottom side of the air cylinder piston due to the surface area loss because of the latch extension. The air pressure is about 190 pounds per square inch. A circular arrangement of air outlets in the top of the switch lead to a regulator valve that keeps the pressure at 180 pounds per square inch. The air entering the top of the switch is forced through passages in the driver that swirl the air over the contact due to the 10 psi differential caused by the regulator.

During operation, air is dumped from the bottom of the air cylinder and the solenoid is actuated. At this point, the driver moves very rapidly under the influence of the air pressure acting on its upper surface. The driver is cushioned by bumpers of suitable material such as polyurethane, for example. The air pressures in the upper and lower chambers are separated by the middle portion of the driver which has an annulus in which is positioned a suitable seal, such as an O-ring for example.

The make switch was designed for a circuit voltage of 1000 volts (peak) across the switch with a 2000 volt (peak) maximum transient rate of rise. The switch is designed for a circuit current of 7.05 ka peak current with a 133 A/μs maximum rate of rise. The switch was designed to close within 0.1 ms of the desired time. In actual tests, closing times with 0.015 ms have been achieved. It will now be understood that there has been disclosed a making switch which can close a circuit and handle high current at a fast operating speed with minimum deviation.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A making switch, comprising:

a housing defining a chamber therein;

a driver having a first end portion, a second end portion and a middle portion, said first end portion extending into the housing chamber, said middle portion and housing forming an air cylinder which controls the movement of the first end portion of the driver in the chamber;

a stationary contact ring having a plurality of contact fingers and being mounted in the housing;

a movable contact ring having a plurality of contacts engageable with the contact fingers and being movable by the driver between an open position at which the stationary and movable contacts are free of electrical engagement and a closed position at which the stationary and movable contacts are in electrical engagement;

a latch associated with the driver and which releasably abuttingly engages the driver with the stationary and movable contacts in the open position; and a solenoid releasably operating the latch and freeing the driver of abutting contact by the latch allowing the contacts to close.

2. A making switch, as set forth in claim 1, wherein the stationary contact fingers are mounted in pairs opposing one another and arranged in two concentric circles.

3. A making switch, as set forth in claim 1, including contact wear pads attached to the ends of the contact fingers.

4. A making switch, as set forth in claim 3, wherein the contact wear pads are composed of a coin silver alloy with a conductivity of about 95%.

5. A making switch, as set forth in claim 1, wherein the movable contacts are plated with silver.

6. A making switch, as set forth in claim 5, wherein the silver is substantially pure.

7. A making switch, as set forth in claim 5, wherein the silver has a thickness of about 0.010 inches.

8. A making switch, as set forth in claim 1, wherein the finger pressure is about seven pounds per contact.

9. A making switch, as set forth in claim 8, wherein the contact pressure is provided by beryllium copper contact springs.

10. A making switch, as set forth in claim 1, including a set of four clamp rings having tapered diameters which convert a downward clamping force to a lateral force.

11. A making switch, as set forth in claim 1, wherein the latch is an over center toggle linkage having two links of equal length.

12. A making switch, as set forth in claim 11, wherein the latch has an over center travel of about 0.03 inches.

13. A making switch, as set forth in claim 11, wherein the latch has an over center travel which is adjustable in the range of about 0.0 inches to about 0.1 inches.

14. A making switch, as set forth in claim 11, wherein the force necessary to overcome the latch is less than about 50 pounds.

15. A making switch, as set forth in claim 1, wherein the chamber and lower part of the air cylinder are pressurized simultaneously when the solenoid switch is latched.

16. A making switch, as set forth in claim 1, wherein the second end portion of the driver has an upper surface of a first preselected area in fluid communication with the housing chamber and a lower surface of a second preselected area which is less than the first preselected area and wherein air pressure in the chamber creates a total pressure on the upper driver surface which is greater than the total air pressure on the lower driver surface causing the driver to close the contacts in response to operation of the solenoid.

17. A making switch, as set forth in claim 1, wherein the first end portion of the driver defines passages through which air is forced causing the air to swirl over the contacts.

18. A making switch, as set forth in claim 1, including a glass epoxy insulating material about the contact fingers in the housing.

* * * * *